US006091438A

United States Patent [19]

Endo

[11] Patent Number: 6,091,438

[45] Date of Patent: Jul. 18, 2000

[54] TRANSFER-TYPE THERMAL PRINTER AND THERMAL TRANSFER PRINTING METHOD USING THE SAME

[75] Inventor: Mitsuharu Endo, Susono, Japan

[73] Assignee: Kabushiki Kaisha TEC, Shizuoka, Japan

[21] Appl. No.: 08/791,565

[22] Filed: Jan. 31, 1997

[30] Foreign Application Priority Data

| | | | |
|---|---|---|---|
| Feb. 9, 1996 | [JP] | Japan | 8-023702 |
| Dec. 25, 1996 | [JP] | Japan | 8-345934 |

[51] Int. Cl.[7] ..... B41J 2/325

[52] U.S. Cl. ..... 347/221; 347/176

[58] Field of Search ..... 347/172, 174, 347/176, 217, 183; 400/120.02, 120.07; 428/304.04, 211, 212; 503/200, 227

[56] References Cited

U.S. PATENT DOCUMENTS

| | | | |
|---|---|---|---|
| 4,574,293 | 3/1986 | Inui et al. | 347/196 |
| 4,612,243 | 9/1986 | Shimazaki et al. | 428/321.3 |
| 4,849,457 | 7/1989 | Ichii et al. | 521/62 |
| 4,916,111 | 4/1990 | Yaguchi et al. | 503/226 |
| 5,196,391 | 3/1993 | Ohno et al. | 503/200 |
| 5,320,897 | 6/1994 | Kondo et al. | 428/195 |
| 5,521,626 | 5/1996 | Tanaka et al. | 347/183 |

FOREIGN PATENT DOCUMENTS

| | | |
|---|---|---|
| 0 283 048 A2 | 9/1988 | European Pat. Off. . |
| 62-197183 | 8/1987 | Japan . |
| WO 94/21470 | 9/1994 | WIPO . |

OTHER PUBLICATIONS

ITE Technical Report vol. 17, No. 27, pp. 19–24, VIR '93–28, May 1993 "Multi contrast steps record of the thermal transfer printing method by the wax ink".

Patent Abstracts of Japan, vol. 95, No. 6, Jul. 31, 1995 & JP 07 061012 A, (Victor Co. of Japan Ltd.), Mar. 7, 1995, *Abstract*.

*Primary Examiner*—N. Le
*Assistant Examiner*—Anh T. N. Vo
*Attorney, Agent, or Firm*—Frishauf, Holtz, Goodman, Langer & Chick, P.C.

[57] ABSTRACT

A technique for transferring at least a part of inks of a plurality of colors onto a recording web sheet in superposition by heating the inks with a thermal head, and by passing the recording web sheet and an ink ribbon, superposed with each other, between the thermal head and a platen. The recording web sheet has a plurality of interconnected pores which have openings formed in a surface of the recording web sheet, and a proportion of a total area of the openings of the pores is more than 50% and less than 80% of a total surface area of the recording web sheet. A proportion of a number of the openings of the pores having a pore diameter of 5–35 μm is more than 50% of a total number of the openings of the pores, and a proportion of a number of the openings of the pores having a pore diameter of at least 35 μm is less than 5% of the total number of the openings of the pores. In addition, a difference between: (i) a contact angle of each of the inks of the plurality of colors and a standard liquid and (ii) a contact angle of the recording web sheet and the standard liquid is not larger than 20 degrees.

8 Claims, 7 Drawing Sheets

TRANSFER-TYPE THERMAL PRINTER AND THERMAL TRANSFER PRINTING METHOD USING THE SAME

BACKGROUND OF THE INVENTION

The present invention relates to a transfer-type thermal printer for thermally transferring a thermally fusible ink on to a recording paper, and a thermal transfer printing method.

A thermal fusion transfer recording carried out by a transfer-type thermal printer is a kind of non-impact recording system for transferring ink which is solid in an ordinary state on to a recording paper for forming a visible pattern by using Joule heat as a recording energy.

According to the thermal fusion transfer recording technique, at first, an ink ribbon having a solid ink layer and a recording paper are superposed with each other, and the ink ribbon and the recording paper are sandwiched between a thermal head and a platen. Next, electric power is applied according to an image signal to a fine heating unit provided on the thermal head, to heat the heating unit. With this heat, the solid ink layer of the ink ribbon is fused and is then adhered on to the recording paper. When the ink ribbon is removed from the recording paper, an ink layer having a desired pattern is transferred on to the recording paper.

The ink ribbon generally consists of an ink layer (1 to 6 $\mu$m, that is about 1 to 6g/m$^2$), a base film (2 to 6 $\mu$m) and a heat-resistant (lubricating) layer (1 to 3 $\mu$m). The ink layer is structured by a coloring agent selected from pigments and dyes, for example, a binder selected from waxes and thermoplastic resins, for example, and various types of additives selected from softening agents and dispersants, for example.

As the base film, polyethyleneterephthalate (hereinafter to be referred to as PET) is mainly used. This PET is softened and fused at 263° C. On the other hand, the surface temperature of the heating unit of the thermal head exceeds 300° C. The heat-resistant layer is provided between the thermal head and the PET in order to prevent an occurrence of a phenomenon called a stick phenomenon in which the ink ribbon is fused to the thermal head to make it difficult to move the ink ribbon. Further, the heat-resistant layer can also have the effect of lubricating properties and antistatic properties.

The binder which occupies 60 to 80 wt % of the ink component determines the thermal fusion characteristics of the ink. In general, the ink of a wax-based binder has such characteristics as a sharp range of melting point and a rapid reduction in viscosity at this melting point or above. On the other hand, the ink of a thermally-fusible resin based binder shows a broad range of melting points and a smooth reduction in viscosity at this melting point or above. The ink having a broad range of melting points can be transferred uniformly even if there are some temperature variations within a heating area. On the other hand, the ink having a sharp range of melting point is excellent in sharpness of an image edge.

A schematic diagram of a part of an example of the thermal head used for the transfer-type thermal printer is shown in FIG. 1. FIG. 2 is a diagram showing a partially cut enlarged portion 10 of FIG. 1. Generally, the thermal head is provided by forming a heat resistor array 6 structured by $Ta_2N$, $RuO_2$, $BaRuO_3$, etc., for example, on a substrate 5 structured by ceramics or the like, by using a thin film process of evaporation or a thick film process of screen printing or the like, for example. In order to improve the heat insulating and an adhesive properties, a glazed layer 7 can also be formed between the array resistor 6 and the substrate 5. Further, the whole of the thermal head is covered by wear resistant layer 8 structured by $TaO_5$, SiN and SiC, for example. A heat discharging panel 9 is also provided on the lower surface of the substrate 5.

For carrying out a color printing by using the thermal head as described above, an ink layer of a first color and a recording paper are sandwiched between the thermal head and the platen, and the ink layer of the first color is transfer printed. Then, the recording paper onto which the ink layer of the first color has been transferred and an ink layer of a second color are superposed and sandwiched between the thermal head and the platen, for printing the ink of the second color on the surface of the recording paper on which the ink of the first color has been printed. Usually, three original colors of Y (yellow), M (magenta) and C (cyan) are used for the color printing, so that transfer printing is repeated at least three times. In this case, in order to obtain desired colors, three kinds of inks are printed to be superposed by suitably repeating the printing.

For the above-described printing, a plane smooth paper called a thermal paper is used exclusively. Usually, a coated layer is provided on this thermal paper for an improved whiteness and for an improved fixing properties of the inks. However, even if this kind of thermal paper is used, it is difficult to superimpose an ink at completely the same position on the paper, with a result that the ink is usually printed with a deviation of about several ten um.

FIG. 3A, FIG. 3B and FIG. 3C are schematic diagrams for showing a status wherein the three colors of Y. M and C are sequentially transferred in this order in one dot on a smooth recording paper 1. The upper diagram connected with dotted lines is a schematic view from the top direction and the lower diagram is a schematic view from the transverse direction. FIG. 3A shows the case where the colors are transferred accurately to the same position. FIG. 3B and FIG. 3C show virtual model diagrams or actual model diagrams of the case where the colors are transferred, with M and C deviated from the position of Y by about several ten $\mu$m, respectively. When M and C are transferred with a deviation of about several ten $\mu$m from the position of Y, the colors are considered to be usually transferred as shown in FIG. 3B. However, since there occurs a difference in level between the first layer and the printing sheet, a part of M and C is chipped respectively so that the colors are transferred as shown in FIG. 3C. When there arises a deviation in the transfer positions of the three colors, as explained above, the transfer of M and C to be superposed on Y becomes insufficient.

FIGS. 4A and FIG. 4B are schematic diagrams for showing a status wherein the three colors of Y, M and C are transferred in this order in three dots on the smooth recording paper 1. FIG. 4A shows a virtual model diagram of the case where the three dots are transferred to accurate positions. FIG. 4B shows an actual model diagram of the case where the dot of C is printed between the two dots which are the superimposition of M on Y. Essentially, when one dot is formed between the two dots formed with a distance of one dot space therebetween, the colors are considered to be transferred as shown in FIG. 4A. However, in actual practice, because of a difference in level formed between the transferred ink layers of two dots and the recording paper, the transfer of the third color becomes insufficient as shown in FIG. 4B.

The above explanation relates to cases wherein inks of three colors are used, but a transfer failure as described above occurs frequently even if inks of two colors are transferred when the ink transfer quantity is not less than 2 $g/m^2$. Further, in the case of superpositioning of three colors, this kind of transfer failure occurs even if the ink transfer quantity is 1 $g/m^2$.

As explained above, conventionally when a color printing is carried out using a smooth recording paper, there arises a difference in level between the ink layer of the first color and the surface of the recording paper, so that the transfer of the ink of the second color can become unstable. Further, in the worst case, a dot of the ink of the second color is formed on only the ink of the first color.

In the case of expressing a halftone by varying a dot size, there is a possibility that case where the dot of the second color will be larger than the dot of the first color even if no positional deviation occurs. In this case, there also arises a problem in that the transfer of the ink of the second color becomes unstable, with a result that the color transfer is not carried out satisfactorily.

Further, when three colors are superposed together or when four colors are superposed together using a black color, the ink transfer becomes more unstable so that the transfer can not be carried out satisfactorily.

In the literature, "Multi-gradation Thermal Transfer Printing according to a Fusible Ink Permeation System", (a technical report of The Institute of Television Engineers of Japan, Vol. 17, No. 27, PP. 19–24, VIR '93–28 May, 1993), there is a description that when a recording paper having a large number of pores on its surface is used, an ink is permeated into the recording paper to ensure a stable transfer.

When a recording paper having many pores on its surface as described in this literature, "Multi-tone Thermal Transfer Printing according to a Fusible Ink Permeation System", was used to carry out a high-speed color printing with a resolution 300 dpi, it was made clear that a transfer failure occurs when a first color (Y), a second color (M) and a third color (C) are transferred sequentially in superposition.

Microphotographs for expressing this status are shown in FIG. 5, FIG. 6 and FIG. 7. FIG. 5 is a microphotograph showing the surface of the recording paper printed with the first color (Y), which is enlarged to 300 times magnification, and FIG. 6 is a microphotograph showing the surface of the recording paper which is further enlarged to 1000 times magnification. From both FIG. 5 and FIG. 6, it is clear that the ink of the first color (Y) is not permeated sufficiently into the surface of the recording paper. FIG. 7 is a microphotograph showing the surface of the recording paper printed with the three colors in superposition, which is enlarged to 100 times. From FIG. 7, it is known that since the permeation of the ink of the first color is insufficient, the dots of the second color (M) and the third color (C) are chipped due to the difference in level between the first color (Y) layer and the recording paper so that a transfer failure occurred. This phenomenon similarly occurs when the resolution is as high as 600 dpi.

As explained above, with a mere provision of pores on the surface of the recording paper, an ink transfer failure may occur in the second color, thereafter resulting in an insufficient color transfer.

Further, there is also a problem in that, in order to achieve a sufficient permeation of inks, it is necessary to fuse the inks sufficiently, which leads to an increasing of the energy to be applied to the head.

Further, according to the conventional transfer-type thermal printer, there is a problem that it is difficult to increase the speed of printing, particularly in the case of a color printing, so that it is difficult to apply the transfer-type thermal printer to a multi-gradation color printing.

The inventors of the present invention studied the causes of the ink transfer failure which occurred in the conventional thermal transfer printing using a recording paper provided with a large number of pores on the surface of the recording paper as described in literature, "Multi-gradation Thermal Transfer Printing according to a Fusible Ink Permeation System". As a result of this study, it was made clear that the causes of the ink transfer failure are a poor balance between an ink quantity to be transferred and an acceptable quantity of permeated ink, a slow permeation speed due to low temperature and high viscosity of inks, a short permeation time due to high speed of printing, etc.

To solve the above problems, various measures can be considered such as a delaying of the printing speed and lowering of the ink viscosity by increasing the applied energy, for example. However, the delaying of the printing speed has a problem of making it impossible to achieve the high-speed printing. Further, the increasing of the applied energy also has a problem of making it impossible to achieve a multi-gradation color printing.

BRIEF SUMMARY OF THE INVENTION

It is a first object of the present invention to provide a transfer-type thermal printer which can securely transfer each ink to a recording web sheet and improve the fixing properties of the inks, and which ensures a sufficient permeation of the inks into the recording web sheet even if a high-speed printing is carried out so that a satisfactory image can be obtained.

It is a second object of the present invention to provide a thermal transfer printing method which makes it possible to securely transfer each ink to a recording web sheet and improve the fixing properties of color inks, and which ensures a sufficient permeation of the color inks into the recording web sheet even if a high-speed printing is carried out so that a satisfactory image can be obtained.

According to a first aspect of the present invention, a transfer-type thermal printer is provided which comprises a thermal head for carrying out heating according to a color image signal for forming an image by using inks of a plurality of colors, an ink ribbon consisting essentially of a base material disposed on the thermal head and a thermally fusible ink layer formed on the base material, and a platen located above the thermally fusible ink layer and which sandwiches a recording web sheet between the platen and the thermally fusible ink layer, for transferring inks fused by heating onto the recording web sheet when the platen is pressed against the recording web sheet, wherein the recording paper has a large number of inter-connected pores continued on the surface, the proportion of the total area of the opening portions of the large number of pores in the total surface area of the recording web sheet is not smaller than 50% and not larger than 80%, the large number of pores include pores of which diameter is not smaller than 5 $\mu$m and not larger than 35 $\mu$m by not less than 50% and pores of which pore diameter exceeds 35 $\mu$m by not larger than 5%, and a difference between a contact angle of each ink to be used and a standard liquid and a contact angle of the recording paper and the standard liquid is not larger than 20 degrees.

According to a second aspect of the present invention, a thermal transfer printing method is provided which uses a transfer-type thermal printer comprising a thermal head, an ink ribbon consisting essentially of a base material disposed on the thermal head and a thermally fusible ink layer formed on the base material, and a platen disposed on the thermally fusible ink layer, comprising the steps of introducing, between the thermally fusible ink layer and the platen, a recording paper having a large number of interconnected pores, with the proportion of the total area of the opening portions of the large number of pores in the total surface area of the recording web sheet being not smaller than 50% and not larger than 80%, and the surface including pores of which pore diameter is not smaller than 5 μm and not larger than 35 μm by not less than 50% and pores of which pore diameter exceeds 35 μm by not larger than 5%, and heating the thermal head according to a color image signal for forming an image by using inks of a plurality of colors to fuse the thermally fusible ink layer, and pressing the platen against the recording web sheet, to transfer the inks fused by heating onto the recording web sheet, wherein a difference between a contact angle of each of the inks and a standard liquid and a contact angle of the recording web sheet and the standard liquid is not larger than 20 degrees.

According to the present invention, in the technique of transferring inks of a plurality of colors onto a recording web sheet for achieving a color printing by superposition of the inks, it is possible to securely achieve the transfer of the inks onto the recording paper by optimizing the balance between the quantity to be transferred and the acceptable quantity of permeated ink, and it is further possible to improve the fixing properties of the inks by providing a satisfactory ink permeability to the recording web sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The file of this patent contains at least one drawing executed in color. Copies of this patent with color drawings (s) will be provided by the Patent and Trademark Office upon request and payment of the necessary fee.

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
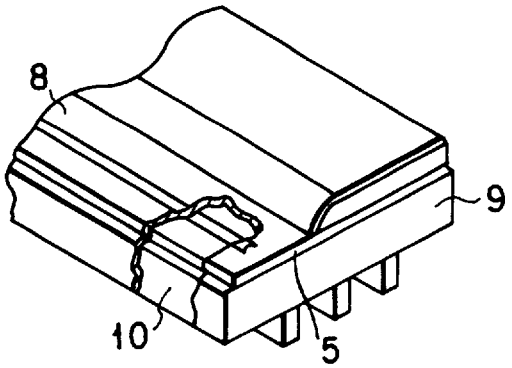
FIG. 1 PRIOR ART
FIGS. 1 and 2 show the structure of a thermal head, FIG. 1 being a perspective view of a part of the thermal and FIG. 2 being a partially enlarged view of the portion encircled by a round frame.
Figure 2:
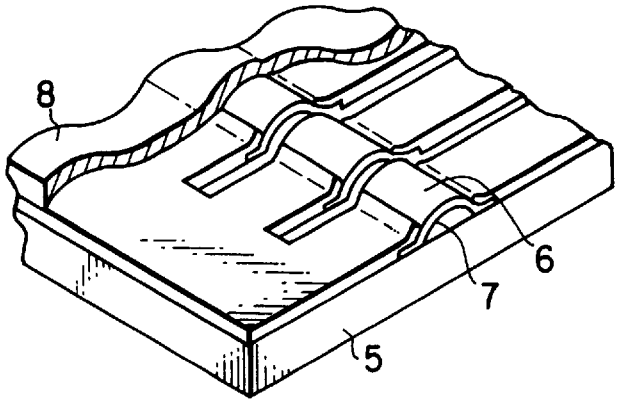
FIG. 2 PRIOR ART
Figure 3A:
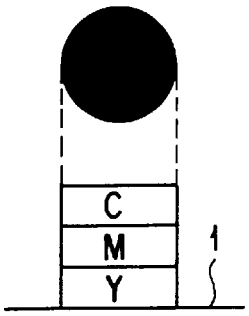
FIG. 3A to FIG. 3C are schematic diagrams for explaining the problems of the conventional ink transfer.
Figure 3B:
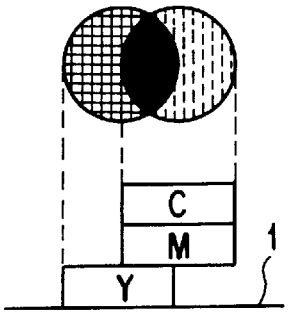
Figure 3C:
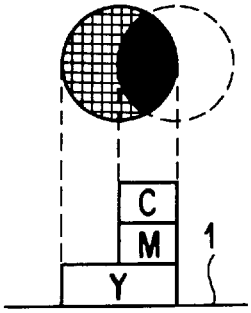
Figure 4A:
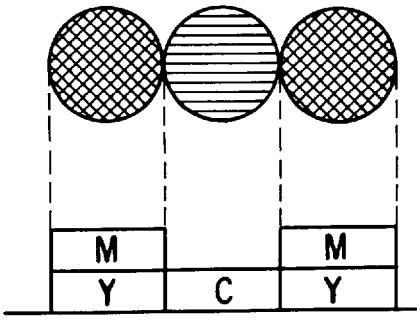
FIGS. 4A and 4B are schematic diagrams for explaining the problems of the conventional ink transfer.
Figure 4B:
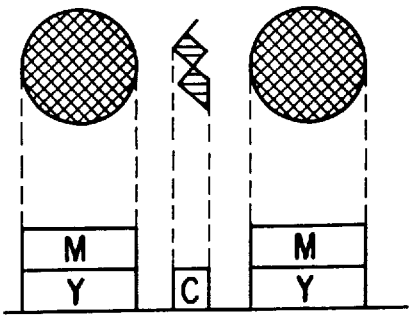
Figure 5:
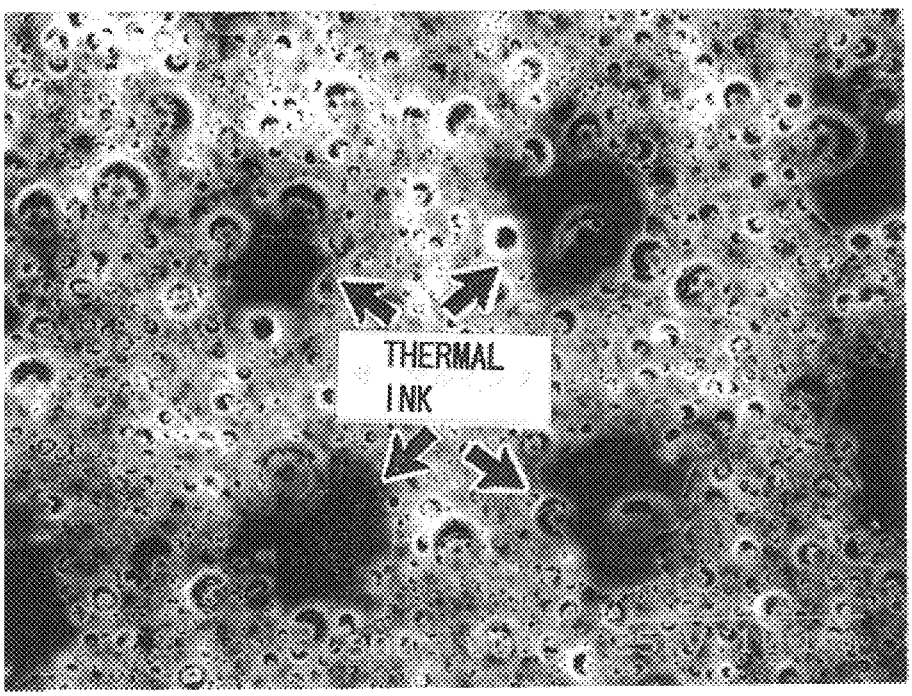
FIG. 5 shows a microphotograph which is an enlargement by 300 times of the surface of a conventional recording paper having a large number of pores when a first color is printed on the recording paper.
Figure 6:
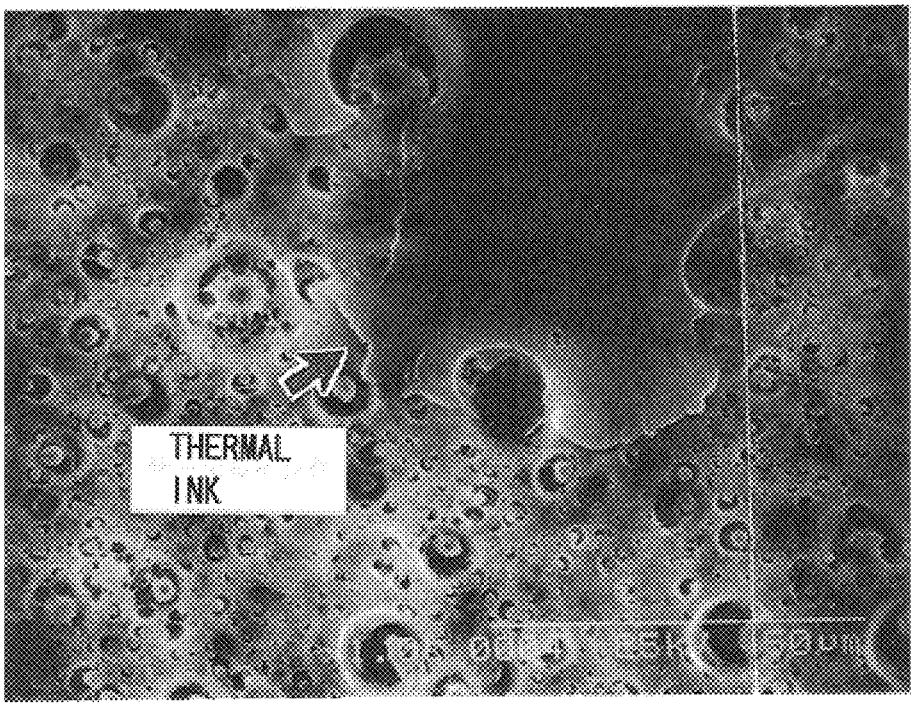
FIG. 6 shows a microphotograph which is an enlargement by 1000 times of the surface of a conventional recording paper having a large number of pores when a first color is printed on the recording paper.
Figure 7:
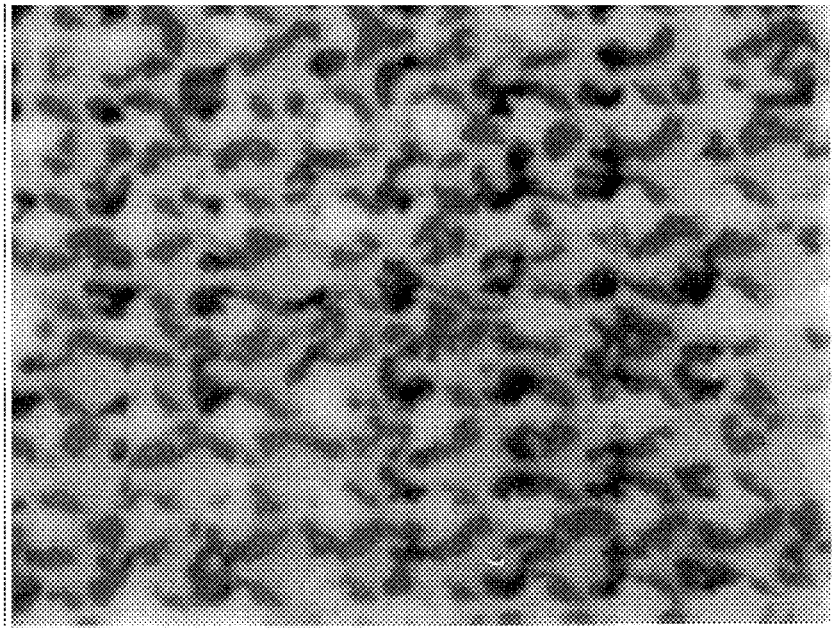
FIG. 7 shows a microphotograph which is an enlargement by 100 times of the surface of a conventional recording paper when three colors are printed in superposition on the recording paper having pores.

The present invention is main classified into the following two aspects.

A transfer-type thermal printer relating to the first aspect of the present invention comprises a thermal head for carrying out heating according to a color image signal for forming an image by using inks of a plurality of colors, an ink ribbon essentially consisting of a base material disposed on the thermal head and a thermally fusible ink layer formed on the base material, and a platen, disposed on the thermally fusible ink layer, and sandwiches a recording paper between the platen and the thermally fusible ink layer, for transferring inks fused by heating onto the recording web sheet when the platen is pressed against the recording web sheet, wherein the recording web sheet to be used has a large number of interconnected pores, the proportion of the total area of the opening portions of the large number of pores relating to the total surface area of the recording web sheet is not smaller than 50% and not larger than 80%, the large number of pores include pores of which pore diameter is not smaller than 5 μm and not larger than 35 μm by at least 50% and pores of which pore diameter exceeds 35 μm by not larger than 5%, and a difference between a contact angle of each ink to be used and a standard liquid and a contact angle of the recording web sheet and the standard liquid is not larger than 20 degrees.

Further, the invention relating to the second aspect shows a method for carrying out a thermal transfer printing by using the transfer-type thermal printer relating to the first aspect, and comprises the steps of:

introducing, between the thermally fusible ink layer and the platen, a recording web sheet having a large number of interconnected pores, with the proportion of the total area of the opening portions of the large number of pores relating to the total surface area of the recording web sheet being not smaller than 50% and not larger than 80%, and the surface including pores of which pore diameter is not smaller than 5 μm and not larger than 35 μm by at least 50% and pores of which pore diameter exceeds 35 μm by not larger than 5%; and heating the thermal head according to a color image signal for forming an image by using inks of a plurality of colors to fusing the thermally fusible ink layer, and pressing the platen against the recording web sheet to, transfer the inks fused by heating on to the recording web sheet, wherein a difference between a contact angle of each ink to be used and a standard liquid and a contact angle of the recording paper and the standard liquid is not larger than 20 degrees.

When the transfer-type thermal printer according to the present invention is used, it is possible to securely achieve the transfer of inks onto the recording paper by optimizing the balance between an ink quantity to be transferred and an acceptable quantity of permeated ink, and it is further possible to improve the fixing properties of the inks by providing a satisfactory ink permeability to the recording paper.

According to this present invention, a resin sheet comprizing a by polyester based resin fiber is preferably used as the recording web sheet.

In the present invention, it is preferable that the recording paper to be used has a surface roughness of not larger than 3 μm under the pressure of not smaller than 2 kg/cm$^2$. By using this kind of web sheet, even a fine ink transfer can be executed so that it becomes possible to improve the reproducibility of low density portions of a high-precision image and a color image.

Further, in the present invention, it is preferable that when the printing speed of the thermal printer is between 0.4 msec/line and 16 msec/line, the head load of the thermal head applied to the platen is not smaller than 0.17 kg/cm and not larger than 0.52 kg/cm per unit length in the main scanning direction and that the ink coating quantity of the ink ribbon is set to be not smaller than 1 g/m$^2$ and not larger than 2.5 g/m$^2$ for each color. With this setting, the energy applied to the thermal head can be reduced and the printing speed can be improved.

It is preferable that the proportion of the total area of the openings of the large number of pores in the surface area of the recording web sheet is not smaller than 65% and not larger than 70%.

It is preferable that the surface of the recording web sheet includes pores of which pore diameter is not smaller than 10 μm and not larger than 30 μm by not less than 50% and pores of which pore diameter exceeds 30 μm by not larger than 5%.

According to the present invention, since the proportion of the total area of the pores in the total surface area of the recording web sheet is not smaller than 50% and not larger than 80%, the skeleton of the surface of the recording web sheet is sufficiently thick and strong and has excellent abrasion-resistance. Moreover, since ther pores are pores of which pore diameter is not smaller than 5 μm and not larger than 35 μm by at least 50% on the surface of the recording web sheet, the ink permeation quantity becomes sufficient and a satisfactory transfer can be achieved even in the case of transferring inks of a plurality of colors in superposition. Further, since there includes pores of which pore diameter exceeds 35 μm by not larger than 5% on the surface of the recording web sheet, it becomes possible to express an intermediate tone and a high-precision image.

Further, despite the fact that the pore diameters are relatively large, the surface roughness can be made smaller when a pressure is applied to the web sheet, so that even a fine ink transfer becomes possible and the expression of low density portions of a high-precision image and a color image can be improved. Further, inks can be sufficiently heated and fused with low energy because of a sufficient load of the head and an air layer (heat insulation layer) formed by a sufficient quantity of pores on the surface of the recording web sheet. Moreover, it becomes possible to promptly permeate the inks into the surface of the recording web sheet. In addition, by setting the difference between the contact angle of each ink and a standard liquid and the contact angle of the recording web sheet and the standard liquid to be not larger than 20 degrees, the ink permeability to the recording paper can be made satisfactory.

The present invention will be explained in detail below with reference to the drawings.

The inventors of the present invention concentrated on the conditions for optimizing the balance between the transfer ink quantity and the permeation acceptable quantity of the ink, ensuring the transfer of each ink on to the recording paper, and for improving the fixing properties of the inks on the recording web sheet by enabling the recording paper to have a satisfactory ink permeability.

The inventors also studied how to improve the expression of low density portions of a high-precision image and a color image by enabling even a fine ink transfer, and how to reduce the energy applied to the thermal head and how to improve the printing speed.

Figure 8:
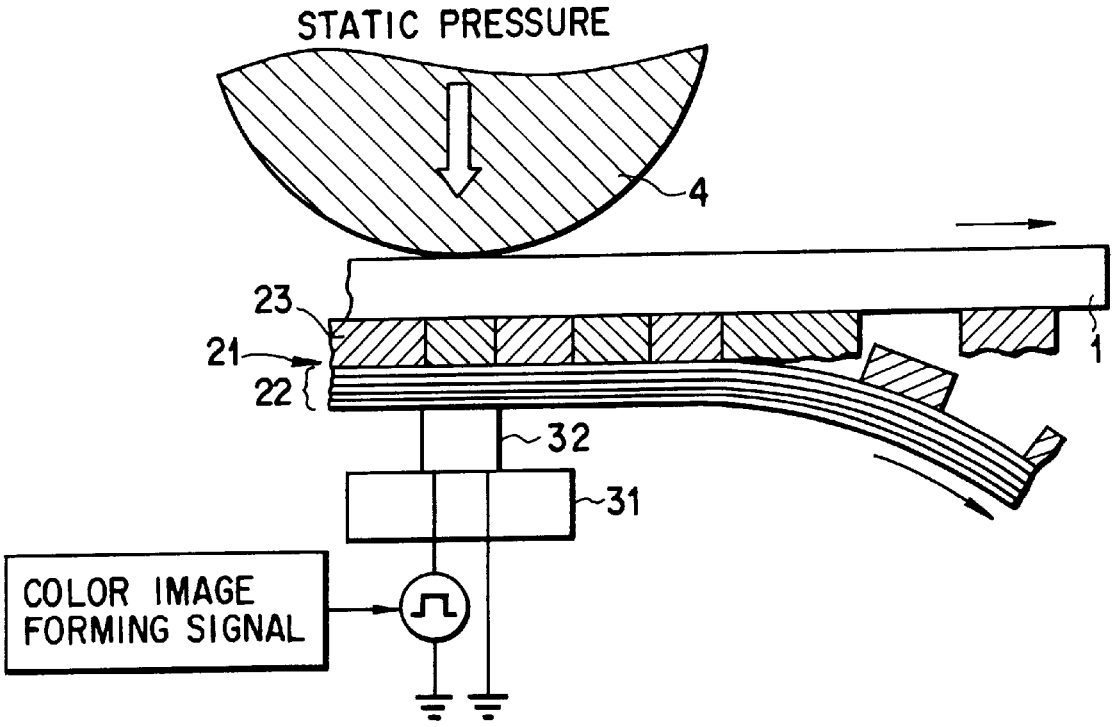
FIG. 8 is a schematic diagram for showing a basic structure of a transfer-type thermal printer.

FIG. 8 is a schematic diagram showing an example of a part of the basic structure of the transfer-type thermal printer relating to the first aspect of the present invention.

This transfer-type thermal printer has such a structure that a recording paper 1 is placed on an ink layer 23 of an ink ribbon 21 made of a base film 22 and the solid ink layer 23, and the ink ribbon 21 and the recording paper 1 are sandwiched between a thermal head 31 disposed at the side of the base film 22 and a platen 4 disposed at the side of the ink ribbon 21.

As the ink ribbon to be used, an ink ribbon having each color of Y, M and C, or Y, M, C and black repeatedly arranged in this order, for example, can be used. Alternately, ink ribbons each having a single color may be used by a plurality of numbers.

In order to carry out a printing by using the printer shown in FIG. 8, at first, an electric power can be applied to a fine heating unit 32 (several ten μm$^2$) provided on the thermal head 31 according to an image signal, to heat the fine heating unit 32.

With this heat, the solid ink layer 23 of the ink ribbon 21 is fused and is adhered on to the recording paper 1. Then, the ink ribbon 21 is removed from the recording paper 1 at a suitable timing, so that the ink layer 23 having a desired pattern according to the image signal can be transferred on to the recording paper 1.

For the transfer-type thermal printer having this kind of basic structure, the inventors studied how to reduce the quantity of ink transferred. When the ink transfer quantity is reduced, the image density is decreased naturally, resulting in deterioration of the image quality. To avoid this problem, increasing of the adding quantity of a coloring agent in the inks was studied. However, no sufficient density was obtained by this, with a conclusion that the transfer ink quantity can not be deceased. Then, it was made clear that in order to obtain a sufficiently highest density, 1 g/m$^2$ or above is desirable as the lowest transfer quantity of ink.

Further, for the permeation acceptable quantity of ink, gas permeability of pores on the recording web sheet is necessary. With this, both the ink permeation quantity and the permeation speed can be improved. It was also made clear that in order to sufficiently permit the permeation of inks of two or more colors, the total area of pores on the surface of the recording web sheet needs to be at least 50%. Further, it was also made known that in the case of superposing three or more colors, it is preferable to have at least 65% for this area.

On the other hand, when the total area of pores on the surface of the recording paper exceeds 80%, the skeleton for forming the surface of the recording web sheet becomes smaller and the abrasion-resistance of the surface of the recording web sheet is lowered. The abrasion-resistance does not have a large problem when the recording web sheet is used as a normal printing material as used in office work. However, there are such problems that when a mending tape (manufactured by Scotch) is applied on the printed matter and the tape is removed, the surface of the recording web sheet is also removed, or when a bar code is printed with these inks and a contact-type scanner such as a pen scanner is applied onto the printed bar code to read the bar code, the bar code becomes missing.

In order to eliminate the above-described problems, it is necessary to set the total area of pores on the surface of the recording paper to be not larger than 80%. With this arrangement, the skeleton of the surface of the recording web sheet becomes thick, with excellent abrasion-resistance, so that the surface of the recording web sheet is not removed with the mending tape or the like. Bars of the bar code will not be removed either even if a contact-type scanner such as a pen scanner is applied onto the printed bar code. The above-described recording web sheet is excellent as a recording web sheet to be used in physical distribution and distribution industry. Particularly when the surface of the recording web sheet is rubbed by a plurality of times, the abrasion-resistance can be increased further when the total area of pores on the surface of the recording web sheet is set to be not larger than 70%.

Further, in the case of high-speed printing such as 0.4 to 16 msec/line, it is preferable to have a pore diameter to be at least 3 $\mu$m or preferably 10 $\mu$m or above, in order to keep ink.

The load (or pressure) of the head at the time of printing also affects the ink permeation, and it is preferable that the load of the head applied in the main scanning direction is at least 0.17 kg/cm per unit length. However, unless the load is not larger than 0.52 kg/cm, there is a tendency that the handling of the ink ribbon becomes difficult. It was also made known that even if the load of the head is increased, inks of three or more colors are not allowed unless the ink transfer quantity (or weight per unit area) per one color is not larger than 2.5 g/m$^2$.

Further, as a result of the study into an improvement in an image quality of an half tone image and a high-precision image, it was known that a fine ink dot can not be formed on a reading web sheet having a too large pore size. Thus, the image quality was evaluated by restricting the maximum diameter of the ink dot. A minimum dot which can be printed on a smooth sheet having almost no uneven surface was formed and measured, with a result that the minimum allowable size is about 30 $\mu$m. Then, an optimum value of a pore diameter was studied by setting the dot maximum pore diameter to around 30 $\mu$m. As a result, it was made clear that colors can be printed in superposition for both an intermediate tone image and a high-precision image, when the proportion of the pores of which pore diameter is not smaller than 5 $\mu$m and not larger than 35 $\mu$m is not smaller than 50% and pores of which pore diameter exceeds 35 $\mu$m is not larger than 5% of the total pores respectively, by considering the balance with the ink retaining quantity.

Based on the above-described aspects, a high-speed color printing was carried out by setting the head load of the thermal head applied to the platen to be not smaller than 0.17 kg/cm and not larger than 0.52 kg/cm per unit length in the main scanning direction, setting the ink coating quantity of the ink ribbon to be not smaller than 1 g/m$^2$ and not larger than 2.5 g/m$^2$ for each color, and using a recording paper having a large number of pores on the surface, by setting the proportion of the total area of the openings of these pore in the total surface area of the recording paper to be not smaller than 50% and not larger than 80%, and setting the proportion of the pores of which pore diameter is not smaller than 5 $\mu$m and not larger than 35 $\mu$m to be not smaller than 50% and pores of which pore diameter exceeds 35 $\mu$m to be not larger than 5% of the total pores respectively.

Figure 9:
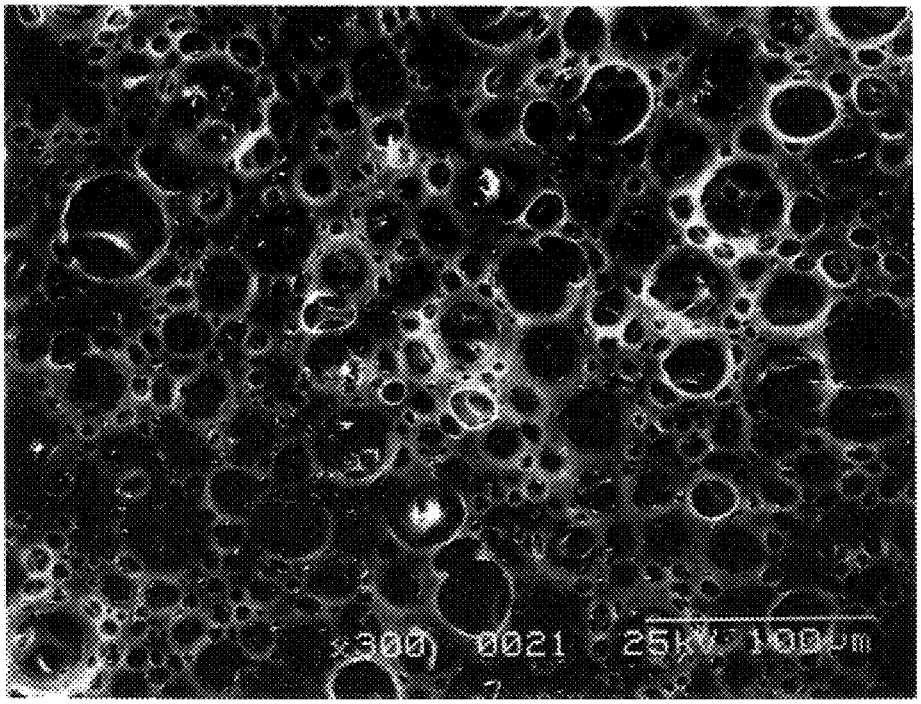
FIG. 9 shows a microphotograph which is an enlargement by 300 times of the surface of a recording paper on which one color is printed according to the present invention.
Figure 10:
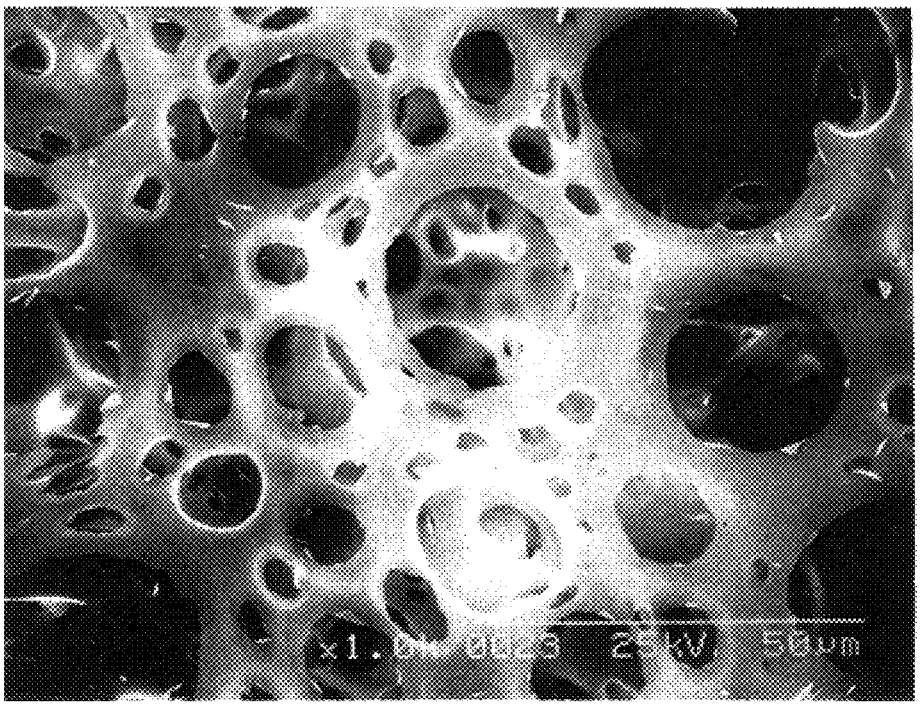
FIG. 10 is a microphotograph which is an enlargement by 1000 times of the photograph in FIG. 9.

FIG. 9 shows a microphotograph which is an enlargement by 300 times magnification of the surface of the recording paper on which a first color (Y) is printed. FIG. 10 shows a microphotograph which is an enlargement by 1000 times magnification of the same surface of the recording paper. In this case, the head load applied in the main scanning direction per unit length was 0.17 to 0.52 kg/cm, the ink coating quantity of the ink ribbon was 1 to 2.5 g/m$^2$ for each ink, the proportion of the total area of the pores in the surface of the recording paper was 50 to 80%, and the difference between a contact angle of the ink and a standard liquid and a contact angle of the recording paper and the standard liquid was not larger than 20 degrees.

As shown in the drawings, the inks were sufficiently permeated into the pores. In this case the inks were securely adhered though not clearly observed from these pictures. Accordingly, abrasion-resistance is improved even if soft inks are used.

Figure 11:
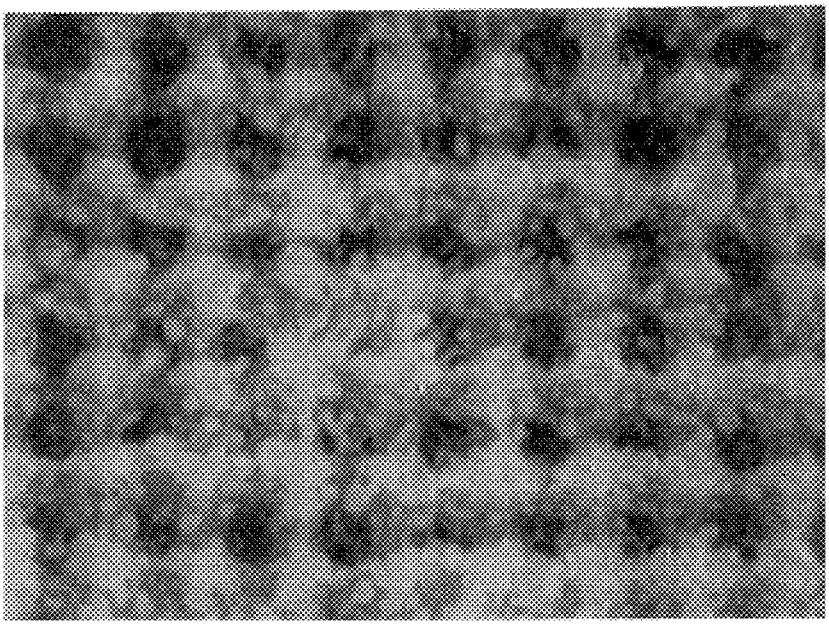
FIG. 11 shows a microphotograph which is an enlargement by 100 times of the surface of a recording paper on which inks of three colors are printed according to the present invention.

FIG. 11 shows a microphotograph which is an enlargement by 100 times magnification of the surface of the recording paper when three colors of inks are printed in superposition. As shown in third picture, inks of the second and third colors were also sufficiently permeated into the recording paper to achieve a satisfactory color printing. Further, fine dot formation was also sufficiently possible.

Further, as compared with the conventional recording paper, the recording paper to be used in the present invention has an air layer formed around the surface of the recording paper so that a heat insulation layer is formed between the ink and the surface of the recording paper, with an increased efficiency of heating the ink by the thermal energy applied from the head at the time of printing. Thus, a low energy printing process can be realized. The load of the head at the time of printing also affects in achieving this low energy. In consideration of this point, it is preferable that the head load is set to be not smaller than 0.17 kg/cm per unit length in the main scanning direction.

Figure 12:
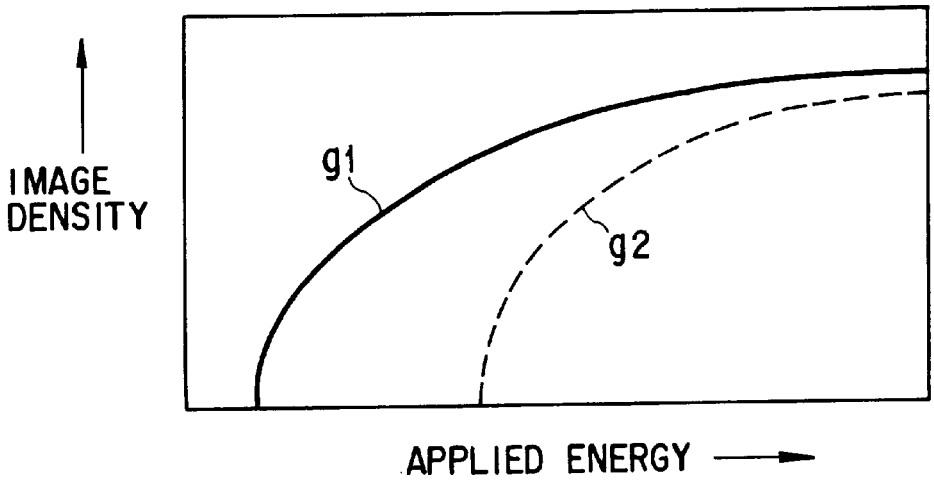
FIG. 12 is a graph for showing a relationship between an applied energy and an image density.

FIG. 12 is a graph showing the relation between the energy applied to the head and the image density. A solid line g1 shows the case where the transfer-type thermal printer relating to the present invention is used for the printing, and a dotted line g2 shows the case where the printing is carried out based on the conventional example, that is, the literature, "Multi-tone Thermal Transfer Printing according a Fusible Ink Permeation System". As is clear from this graph, according to the conventional example, the applied energy does not become smaller even if the image density is in the low status. Therefore, it was not possible to achieve a lower energy in total. On the other hand, according to the present invention, in the status of low image density, it was possible to make the applied energy sufficiently smaller so that a lower energy was able to be achieved in total.

Further, when the recording paper of the surface structure according to the present invention is used, a cushioning effect is obtained on the surface of the recording paper, so that difference in level of ink can be made sufficiently be decreased. Even if an ink difference in level is generated, the ink can be absorbed to ensure a secure transfer of ink. Further, when a normal paper is used as the base of the recording paper, a sufficient cushioning can be obtained even if the surface coated layer is a resin layer.

Figure 13:
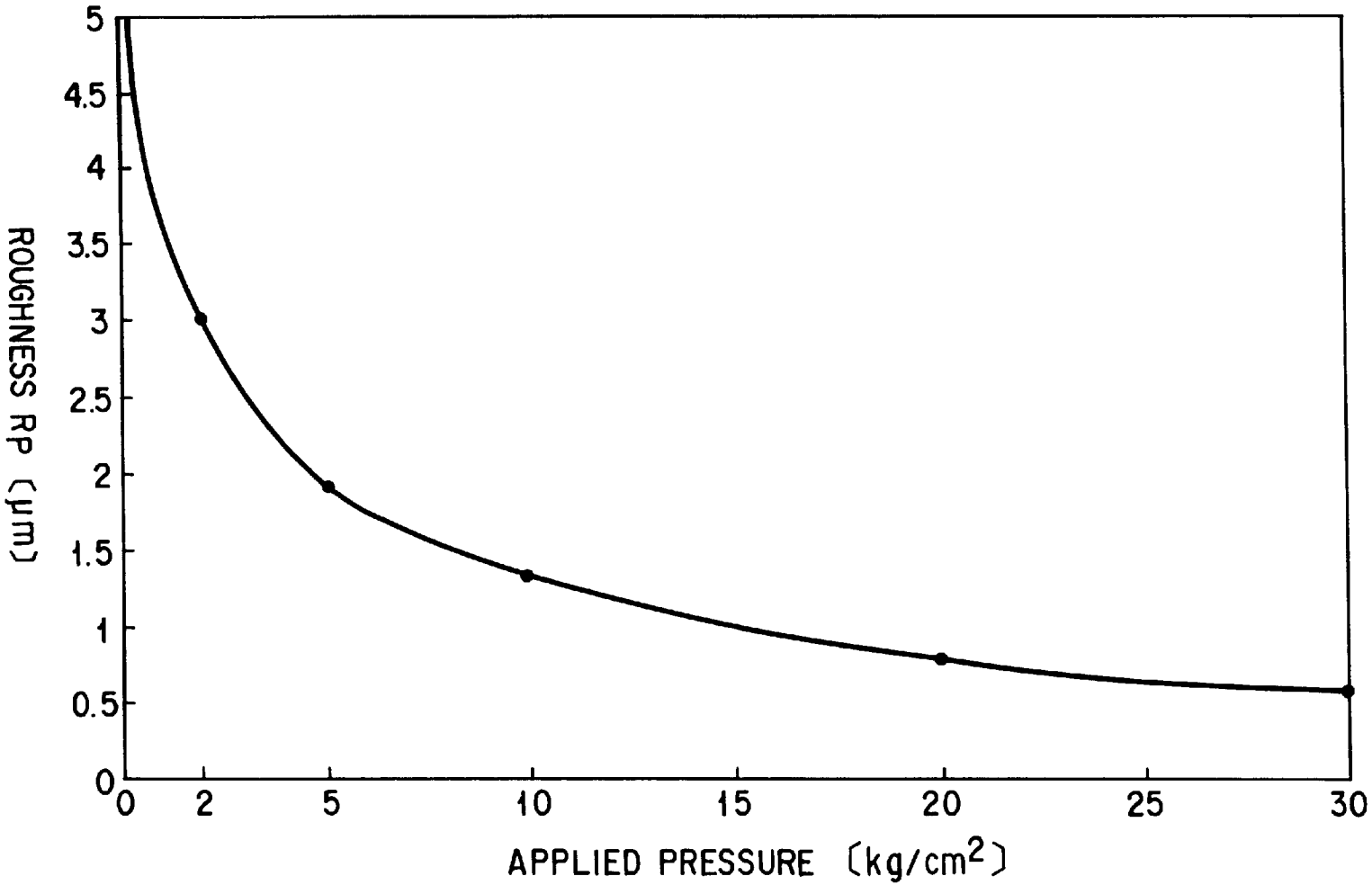
FIG. 13 is a graph for showing a relation between the pressure and the surface roughness of a recording paper.

FIG. 13 is a graph showing a relation between the applied pressure and the surface roughness when the recording paper having the surface structure relating to the present invention is used. As is clear from this graph, when the pressure applied to this recording paper is set to be not smaller than 2 kg/cm$^2$, the surface roughness can be set to be not larger than 3 $\mu$m. With this arrangement, the surface roughness of the recording paper used in the present invention can be set to a level approximately the same as the surface roughness of the recording paper with pores having smaller pore diameters. Thus, even a fine ink transfer is made possible and the expression of low density portions of a high-precision image and a color image can be improved.

Figure 14:
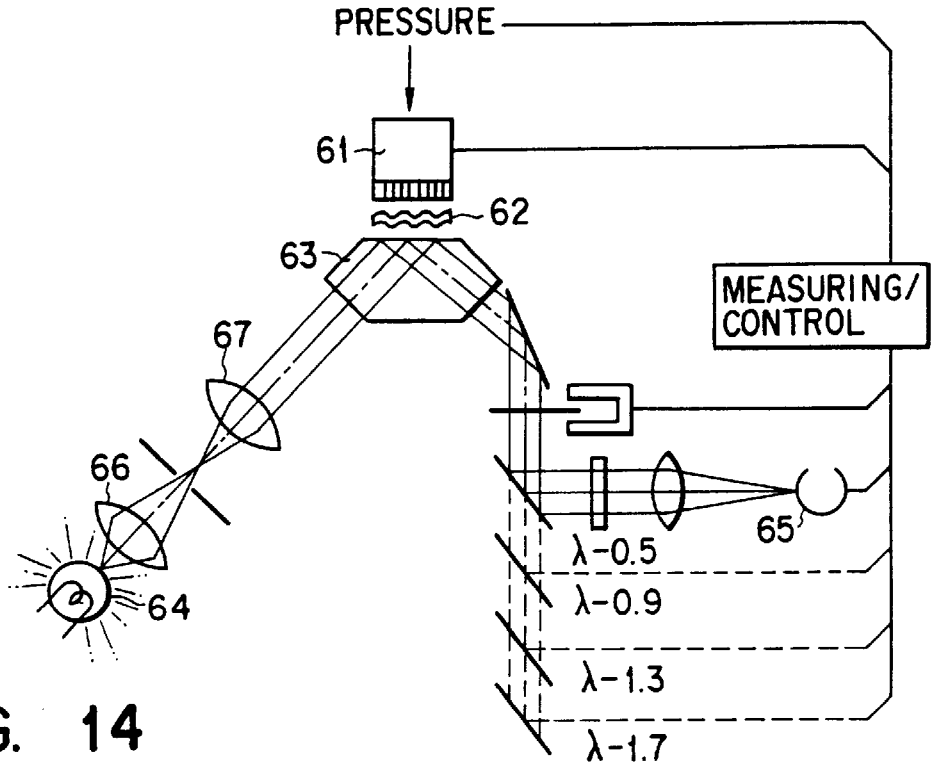
FIG. 14 is a diagram for showing a structure of a microtopograph which is used for measuring the roughness of a recording paper.

The measurement of the surface roughness of the recording paper was carried out by using an optical dynamic print smoothness measuring apparatus called a microtopograph (manufactured by Toyo Seiki). FIG. 14 is a diagram showing the schematics of the microtopograph. As shown in the diagram, the microtopograph includes lenses 66 and 67 for collimating a light from a light source 64, a prism 63 provided in the proceeding direction of a light having passed through the lenses 66 and 67, a sample 62, a load cell rubber blanket 61 for pressing this sample 62, a light receiver 65 for detecting a light reflected by the sample 62, and a measuring and control circuit. This microtopograph is an apparatus for measuring a physical quantity proportional to an average depth of a recess formed on the paper when a paper is dynamically pressured against the plane of the prism, or roughness Rp (printing roughness).

Figure 15:
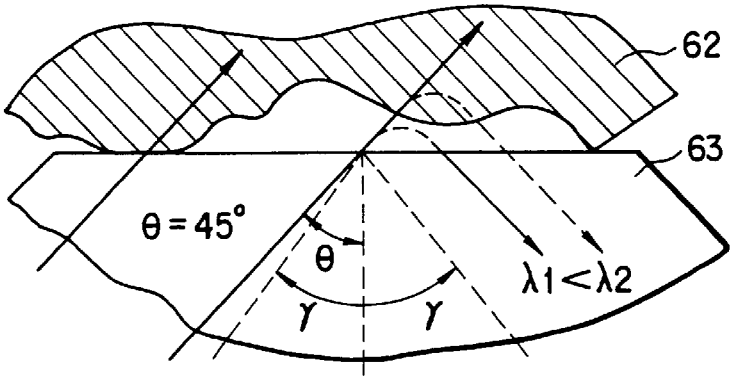
FIG. 15 is a diagram for explaining the measurement principle according to a microtopograph.

FIG. 15 shows a diagram for explaining the principle of the value of Rp. A light is reflected by slightly sticking out from the plane of the prism when making a total reflection. The magnitude of this stick-out is proportional to the wavelength. The stick-out light is divided into a light which is applied to the sample and reflected and transmitted and a light which is reflected without being applied to the sample. The proportion of the quantity of the transmitted light in the quantity of an incident light is the proportion of an existence of the sample at the stick-out depth of the waveform, and this is called an optical contact rate F ($\lambda$). By approximating the distribution of the depth direction of the paper (optical contact rate) by a normal distribution function using the waveforms as a parameter, a density function of the recess can be determined from the optical contact rate of four waveforms. By integrating this in the wavelength direction, a roughness Rp ($\mu$m) proportional to the capacity of the recess or average depth of the recess is obtained.

By using the above-described microtopograph, the roughness Rp($\mu$m) was measured by setting the measurement length to 0.5 to 1.7 $\mu$m and the measurement time to 100 msec after applying the pressure. FIG. 13 is the graph which shows the result of this measurement.

Further, as a result of checking the chemical adhesion between the ink and the recording paper, it was made clear that when the difference between the contact angle of the ink and a standard liquid such as pure water and alcohol and the contact angle of the recording paper and the standard liquid is set to be not larger than 20 degrees, the permeability of the ink to the recording paper or the adhesion becomes satisfactory so that the fixing properties of the ink on to the recording paper is improved.

In general, the adhesion of a material is evaluated by the contact angle and is evaluated as the wetting of a liquid and a solid. Since the ink and the recording paper are both solid in the normal temperature, the wetting of these can not be measured directly. However, by using a standard liquid such as pure water and alcohol, it is possible to measure a relative adhesion by measuring the contact angle of the standard liquid with the ink and the recording paper respectively.

Figure 16:
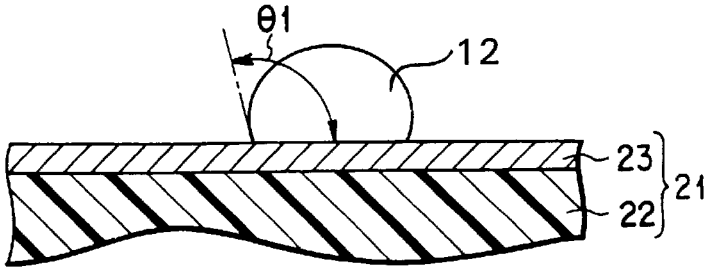
FIG. 16 is a schematic diagram for explaining a contact angle of an ink and a standard liquid.
Figure 17:
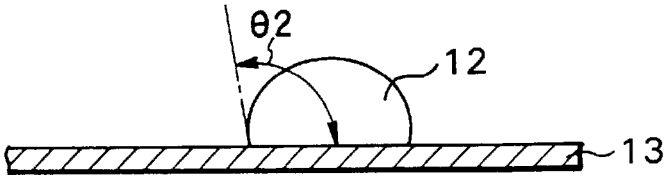
FIG. 17 is a schematic diagram for explaining a contact angle of a recording paper and a standard liquid.

At first, one part of an ink ribbon is kept horizontally with adding tension from both side in longitudinal direction. As shown in FIG. 16, a standard liquid 12, whose quantity is minimized to suppress a gravitational effect, is dropped to place on an ink (layer) 21 of the ink ribbon, and then a contact angle θ1 is measured by using a contact angle meter manufactured by Kyowa Kaimen Kagaku Co., Ltd. Next, as shown in FIG. 17, a contact angle θ2 is measured in a similar manner by placing the standard liquid 12, whose quantity is minimized to suppress a gravitational effect, on a recording paper 1. A relation between the contact angles θ1 and 2 and the reproducibility and the adhesion (abrasion-proof) of the printing dot on the recording paper 13 were then studied.

Table 1 shows a result of measuring the contact angle θ1 when a water drop of pure water having a diameter of 1.5 mm as the standard liquid 12 is placed on the ink 11.

As shown in Table 1, the resin system black, the resin system M (magenta), the resin system C (cyan) and the resin system Y (yellow) had the contact angle q1 of 105°, 100°, 105° and 108° respectively. The contact angle for all the wax system inks was 105° .

TABLE 1

| INK | CONTACT ANGLE |
|---|---|
| RESIN BASED BLACK | 105° |
| RESIN BASED M | 100° |
| RESIN BASED C | 105° |
| RESIN SYSTEM Y | 108° |
| ALL WAX BASED INKS | 105° |

Table 2 shows a result of measuring the contact angle 0l when a water drop of pure water having a diameter of 1.5 mm as the standard liquid 12 is placed on the porous recording paper 13. The contact angle for each case was as follows: 100° for the recording paper A and the recording paper B; 94° for the recording paper C; 90° for the recording paper D and the recording paper F; 125° for the recording paper E; 106° for the recording paper G; 118° for the recording paper H; 120° for the recording paper I and the recording paper K; 119° for the recording paper J; 84° for the recording paper L; 80° for the recording paper M; and 130° for the recording paper N.

In this case, the recording papers A to K have a large number of interconnected pores which is opened to the surface of the papers, by setting the proportion of the total area of openings of these pores in the total surface area of the recording paper to be not smaller than 50% and not larger than 80%, and setting the proportion of the pores of which pore diameter is not smaller than 5 m and not larger than 35 μm to be not smaller than 50% and pores of which pore diameter exceeds 35 μm to be not larger than 5% of the total pores respectively. The recording paper L has the proportion of the total area of openings of these pores in the total surface area of the recording paper to be smaller than 50%, and the recording paper M has the proportion of the total area of openings of these pores in the total surface area of the recording paper to be smaller than 50% and further has the proportion of the pores having the pore diameter of 1 μm to 5 μm to be not smaller than 50%. The recording paper N has the proportion of the total area of openings of these pores in the total surface area of the recording paper to be not smaller than 50% and further has the proportion of the pores having the pore diameter of 1 μm to 5 μm to be not smaller than 50%.

TABLE 2

| POROUS PAPER | CONTACT ANGLE | PORE EXISTENCE RATE (%) | EXISTENCE RATE OF PORES OF DIAMETERS 5 μm to 35 μm | EXISTENCE RATE OF PORES OF DIAMETERS EXCEEDING 35 μm | ADHESION | REPRODUCIBILITY |
|---|---|---|---|---|---|---|
| A | 100° | 50 to 80 | *1 ≧50% | *2 ≦5% | Good | Good |
| B | 100° | 50 to 80 | ≧50% | ≦5% | Good | Good |
| C | 94° | 50 to 80 | ≧50% | ≦5% | Good | Good |
| D | 90° | 50 to 80 | ≧50% | ≦5% | Good | Good |
| E | 125° | 50 to 80 | ≧50% | ≦5% | Good | Good |
| F | 90° | 50 to 80 | ≧50% | ≦5% | Good | Good |
| G | 106° | 50 to 80 | ≧50% | ≦5% | Good | Good |
| H | 118° | 50 to 80 | ≧50% | ≦5% | Good | Good |
| I | 120° | 50 to 80 | ≧50% | ≦5% | Good | Good |
| J | 119° | 50 to 80 | ≧50% | ≦5% | Good | Good |
| K | 120° | 50 to 80 | ≧50% | ≦5% | Good | Good |
| L | 84° | Less Than 50% | — | — | No Good | No Good |
| M | 80° | Less Than 50% | — | — | Normal | Normal |
| N | 130° | 50 to 80 | — | — | Normal | Normal |

*1 ≧50% means not less than 50%
*2 ≦5% means not more than 5%

An ink of which contact angle of a water drop with each of the recording papers A to N is 105° was used for printing to check the reproducibility and adhesion (abrasion-resistance). The result of the check is shown in Table 2. As is clear from Table 2, the recording paper A to K exhibited excellent results, the recording papers M and N showed neither good nor bad results, and the recording paper L showed bad results.

The adhesion (abrasion-proof) was tested by removal of the ink from the recording paper after printing and scratching with a claw, and observed the ink on the paper with using a microscope.

In the case that no peeling and no scratch is found, this was evaluated as good. In the case that some of ink dots would be peeled or scratched partly, this was evaluated as normal. In the case that most of ink dots would be more deteriorated by the test, this evaluated as no good.

The reproducibility was measured by relatively viewing comparing with a standard sample with using a microscope, observing with using differential colorimeter, and densitometer, and was evaluated Good, Normal and No Good due to area of superposed ink and ink transfer quantity comparing with that of the standard sample.

From the above results, the recording paper which showed the excellent results in the reproducibility and the adhesion (abrasion-proof) of the printing dot for the ink having the contact angle 105° with a water drop was the recording paper which has the range of 90° to 125° for the contact angle with a water drop. From the above, it was made clear that when the difference between the contact angle of the ink and the water drop and the contact angle of the recording paper and the water drop is set to be not larger than 20 degrees, the wetting or adhesion of the ink and the recording paper becomes satisfactory and the fixing of the ink to the recording paper can be improved.

For the recording paper, the paper having a contact angle in the range of 90° C. to 125° can be easily manufactured although the contact angle varies depending on the pore diameters and the proportion of the area of the pores even if the surface material is the same. From this fact, it is desirable that the ink having a contact angle of around 105° is used.

Further, the technique used for the transfer-type color thermal printer of the present invention has particularly remarkable effects in the color printing. However, it is needless to mention that the technique of the present invention can also be sufficiently applied to a mono-color transfer thermal printer, and in this case, the transfer of an ink on to the recording paper can be made securely by optimizing the balance between the quantity of the transfer ink and the permeation acceptable quantity, and further, the wetting of the ink and the recording paper can be made satisfactory so that the fixing of the ink is improved.

Additional advantages and modifications will readily occur to those skilled in the art. Therefore, the invention in its broader aspects is not limited to the specific details and representative embodiments, shown and described herein. Accordingly, various modifications may be made without departing from the spirit or scope of the general inventive concept as defined by the appended claims and their equivalents.

I claim:

1. A transfer-type thermal printer, comprising:

a thermal head for providing heat according to a color image signal for forming an image using inks of a plurality of colors;

an ink ribbon including a base material disposed on said thermal head and a thermally fusible ink layer formed on said base material; and a platen located opposite to said thermally fusible ink layer so that a recording sheet passes therebetween, said ink ribbon transferring at least one of the inks of the plurality of colors onto said recording sheet by thermal fusion when said platen is pressed against said recording sheet, wherein said recording sheet has a plurality of interconnected pores which have openings formed in a surface of said recording sheet, wherein a proportion of a total area of the openings of said pores is more than 50% and less than 80% of a total surface area of said recording sheet, wherein a proportion of a number of the openings of said pores having a pore diameter of 5–35 μm is more than 50% of a total number of the openings of said pores, wherein a proportion of a number of the openings of said pores having a pore diameter of at least 35 μm is less than 5% of the total number of the openings of said pores, wherein a difference between: (i) a contact angle of each of the inks of the plurality of colors and a liquid comprising at least one of water and alcohol, and (ii) a contact angle of said recording sheet and said liquid is not larger than 20 degrees; and wherein a proportion of the total surface area of said recording sheet which includes pores having a pore diameter not smaller than 10 μm and not larger than 30 μm is at least 50%, and a proportion of the total surface area of said recording sheet which includes Pores having a Pore diameter exceeding 30 μm is not larger than 5%.

2. The transfer-type thermal printer according to claim 1, wherein said recording sheet has a surface roughness of not larger than 3 μm under a pressure not smaller than 2 kg/cm$^2$.

3. The transfer-type thermal printer according to claim 1, wherein, when a printing speed of said thermal printer is between 0.4 msec/line and 16 msec/line, (i) a load of said thermal head applied to said platen is not smaller than 0.17 kg/cm and not larger than 0.52 kg/cm per unit length in a main scanning direction, and (ii) an ink coating quantity of the thermally fusible ink layer of said ink ribbon is not smaller than 1 g/m$^2$ and not larger than 2.5 g/m$^2$ for each of the inks of the plurality of colors.

4. The transfer-type thermal printer according to claim 1, wherein the proportion of the total area of the openings of said pores is not smaller than 65% and not larger than 70% of the total surface area of said recording web sheet.

5. A thermal transfer printing method which is performed using a transfer-type thermal printer comprising a thermal head, an ink ribbon including a base material disposed on said thermal head and a thermally fusible ink layer formed on said base material, and a platen disposed on said thermally fusible ink layer, said method comprising the steps of:

passing a recording sheet between said thermally fusible ink layer and said platen, said recording sheet having a plurality of interconnected pores which have openings formed in a surface of said recording sheet, wherein a proportion of a total area of the openings of said pores is more than 50% and less than 80% of a total surface area of said recording sheet, wherein a proportion of the number of the openings of said pores having a pore diameter of 5–35 μm is more than 50% of a total number of the openings of said pores, and wherein a proportion of a number of the openings of said pores having a pore diameter of at least 35 μm is less than 5% of the total number of the openings of said pores; and heating said thermal head according to a color image signal for forming an image using inks of a plurality of colors to fuse said thermally fusible ink layer, and pressing said platen against said recording sheet to transfer said inks fused by heating onto said recording sheet, wherein a difference between: (i) a contact angle of each of said inks of the plurality of colors and a liquid comprising at least one of water and alcohol, and (ii) a contact angle of said recording web sheet and said liquid is not larger than 20 degrees; and wherein a proportion of the total surface area of said recording sheet which includes pores having a pore diameter not smaller than 10 μm and not larger than 30 μm is at least 50%, and a proportion of the total surface area of said recording sheet which includes pores having a pore diameter exceeding 30 μm is not larger than 5%.

6. The thermal transfer printing method according to claim 5, wherein said recording sheet has a surface roughness of not larger than 3 μ m under a pressure not smaller than 2 kg/cm$^2$.

7. The thermal transfer printing method according to claim 5, wherein, when a printing speed of said thermal printer is between 0.4 msec/line and 16 msec/line, (i) a load of said thermal head applied to said platen is not smaller than 0.17 kg/cm and not larger than 0.52 kg/cm per unit length in a main scanning direction, and (ii) an ink coating quantity of the thermally fusible ink layer of said ink ribbon is not smaller than 1 g/m$^2$ and not larger than 2.5 g/m$^2$ for each of the inks of the plurality of colors.

8. The thermal transfer printing method according to claim 5, wherein the proportion of the total area of the openings of said pores is not smaller than 65% and not larger than 70% of the total surface area of said recording web sheet.

* * * * *